US009220333B2

(12) United States Patent
Losos et al.

(10) Patent No.: US 9,220,333 B2
(45) Date of Patent: Dec. 29, 2015

(54) ADJUSTABLE LUMBAR SUPPORT FOR MOUNTING ON A BACKPACK AND BACKPACK HAVING THE SAME

(71) Applicant: Mine Safety Appliances Company, Cranberry, PA (US)

(72) Inventors: David J. Losos, Evans City, PA (US); Stephen J. Denninger, Pittsburgh, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 69 days.

(21) Appl. No.: 14/141,557

(22) Filed: Dec. 27, 2013

(65) Prior Publication Data

US 2015/0144675 A1 May 28, 2015

Related U.S. Application Data

(60) Provisional application No. 61/909,463, filed on Nov. 27, 2013.

(51) Int. Cl.

| | |
|---|---|
| ***A45F 3/04*** | (2006.01) |
| ***A45F 3/10*** | (2006.01) |
| *A45F 3/12* | (2006.01) |

(52) U.S. Cl.

CPC . *A45F 3/047* (2013.01); *A45F 3/10* (2013.01); *A45F 2003/045* (2013.01); *A45F 2003/127* (2013.01)

(58) Field of Classification Search

CPC ..... A45F 3/04; A45F 2003/045; A45F 3/047; A45F 2003/127

USPC ..... 224/627, 628, 631, 632, 637, 262; 128/205.22; 405/185

See application file for complete search history.

(56) References Cited

U.S. PATENT DOCUMENTS

| | | | | |
|---|---|---|---|---|
| 995,458 | A * | 6/1911 | Harriman | 224/651 |
| 4,099,657 | A * | 7/1978 | Zufich | 224/262 |
| 4,298,149 | A * | 11/1981 | Gottschalk et al. | 224/201 |
| 4,676,418 | A | 6/1987 | Lowe | |
| 5,004,135 | A * | 4/1991 | Dufournet et al. | 224/632 |
| 5,449,102 | A * | 9/1995 | Sason | 224/632 |
| 5,609,278 | A * | 3/1997 | Fresco | 224/153 |

(Continued)

FOREIGN PATENT DOCUMENTS

| | | | |
|---|---|---|---|
| DE | 102005061067 | A1 * | 7/2006 |
| DE | 102008025822 | B3 * | 4/2010 |

(Continued)

OTHER PUBLICATIONS

Product Sheet for AirHawk II Air Mask, http://s7d9.scene7.com/is/content/minesafetyappliances/AirHawk%20II%20Bulletin%20-%20EN, 8 pages.

(Continued)

*Primary Examiner* — Justin Larson
(74) *Attorney, Agent, or Firm* — The Webb Law Firm

(57) ABSTRACT

An adjustable lumbar support for mounting upon the chassis of a backpack has a lumbar support pad and a slider assembly slidably attaching the lumbar support pad to the chassis. The assembly has a locking slider that, together with the support pad, is indexable to at least two different positions along the chassis. A backpack may have such an adjustable lumbar support.

18 Claims, 10 Drawing Sheets

(56) References Cited

U.S. PATENT DOCUMENTS

| | | | | |
|---|---|---|---|---|
| 5,954,250 | A * | 9/1999 | Hall et al. | 224/262 |
| 6,079,602 | A * | 6/2000 | Howell | 224/637 |
| 6,290,111 | B1 * | 9/2001 | Hedenberg et al. | 224/262 |
| 6,321,959 | B1 * | 11/2001 | Howell | 224/262 |
| 7,997,466 | B2 * | 8/2011 | Fidrych et al. | 224/634 |
| 8,006,877 | B2 * | 8/2011 | Lowry et al. | 224/633 |
| 8,172,117 | B2 * | 5/2012 | Maggi | 224/634 |
| 8,182,439 | B2 * | 5/2012 | Glenn | 602/19 |
| 8,312,600 | B2 * | 11/2012 | Colorado | 24/3.7 |
| 8,714,424 | B2 * | 5/2014 | Oddou et al. | 224/262 |
| 8,740,028 | B2 * | 6/2014 | Hairston et al. | 224/636 |
| 8,926,537 | B2 * | 1/2015 | Ingimundarson et al. | 602/19 |
| 8,991,671 | B2 * | 3/2015 | Gill et al. | 224/628 |
| 2006/0151559 | A1 | 7/2006 | Gravseth | |
| 2008/0035686 | A1 * | 2/2008 | Gregory | 224/262 |
| 2008/0164293 | A1 * | 7/2008 | Foissac et al. | 224/633 |
| 2008/0257928 | A1 | 10/2008 | Lowry et al. | |
| 2010/0243694 | A1 * | 9/2010 | Oddou et al. | 224/633 |
| 2010/0282252 | A1 * | 11/2010 | Cheesman et al. | 128/202.19 |
| 2011/0198377 | A1 * | 8/2011 | Froidevaux et al. | 224/633 |
| 2014/0014700 | A1 * | 1/2014 | Gill et al. | 224/637 |
| 2014/0151424 | A1 * | 6/2014 | Hexels | 224/637 |
| 2015/0041512 | A1 * | 2/2015 | Rief et al. | 224/633 |

FOREIGN PATENT DOCUMENTS

| | | | |
|---|---|---|---|
| EP | 2522250 | A1 * | 11/2012 |
| FR | 2664139 | A1 | 1/1992 |
| WO | WO 2013169100 | A1 * | 11/2013 |

OTHER PUBLICATIONS

Product Sheet for AirGo Pro and AirMaXX Air Masks, www.msasafety.com, 16 pages.

Product Sheet for Drager PSS 7000, http://www.draeger.com/sites/assets/publishingimages/products/cre_pss_7000/attachments/pss_7000_pi_9046204_en.pdf, 6 pages.

Product Sheet for SABRE H2S Safety Equipment, http://www.sabreh2s.com/h2s-safety-equipment.html?page=shop.product_details&flypage=flypage.tpl&product_id=18&category_id=8, 1 page.

Product Sheet for Sperian Fire Warrior SCBA, 14 pages.

Product Sheet for Interspiro Spiromatic S4, http://www.ceeindustrial.com/public/data/companyCatalogue1227466030.pdf, 2 pages.

* cited by examiner

ADJUSTABLE LUMBAR SUPPORT FOR MOUNTING ON A BACKPACK AND BACKPACK HAVING THE SAME

CROSS REFERENCE TO RELATED APPLICATIONS

This application claims benefit of priority from U.S. Provisional Patent Application No. 61/909,463, filed Nov. 27, 2013, which is incorporated herein by reference in its entirety.

BACKGROUND OF THE INVENTION

1. Field of the Invention

The invention relates to a backpack and, more particularly, to a lumbar support that may be used on a backpack wherein the lumbar support may be indexed to different positions on the backpack to accommodate a user and may be rotated on the backpack to accommodate the user.

2. Description of Related Art

Backpacks used for self-contained breathing apparatus (SCBA) are typically used by first responders or rescuers in an environment in which the air is heated and/or contaminated. Frequently, the first responder is in a situation where physical agility is paramount. Therefore, any factor that contributes to the efficiency of the first responder is important. Included in these factors is properly-fitted equipment. Typically, the backpack for an SCBA is a standard size and strap adjustments are made for the different sizes of an individual. However, while straps for such apparatus may be easily adjustable, the base of the backpack typically includes a lumbar support, and it is important for this lumbar support to be located properly in the lumbar region of the individual.

Therefore, there is a need in the art for an arrangement for adjusting a lumbar support on the backpack but, furthermore, for an arrangement that is relatively simple and robust.

Additionally, many backpacks include a lumbar support that is rigidly attached to the chassis of the backpack. Therefore, there is a further need in the art for a lumbar support that is firmly secured to the backpack but, at the same time, permits for some rotation relative to the backpack chassis to accommodate the motion of the user.

SUMMARY OF THE INVENTION

Generally, provided is a lumber support that improves upon and provides additional features with respect to known backpacks having lumbar supports. Preferably, provided is a lumbar support for a backpack used with an SCBA that allows adjustment of the lumbar support along a portion of the length of the backpack. Preferably, provided is an adjustment arrangement that is simple to use and robust. Preferably, provided is a lumbar support that permits rotation of the lumber support on the backpack to accommodate the motion of the user.

In one preferred and non-limiting embodiment, provided is an adjustable lumbar support for mounting upon the chassis of a backpack and includes a lumbar support pad and a slider assembly slidably attaching the lumbar support pad to the chassis. The assembly has a locking slider that, together with the support pad, is indexable to at least two different positions along the chassis.

In another preferred and non-limiting embodiment, provided is a rotatable lumbar support for mounting upon the chassis of a backpack comprised of a lumbar support pad and a connector having a central axis. The connector secures the lumbar support pad to the chassis and allows the lumbar support pad to rotate about the central axis relative to the chassis.

In a further preferred and non-limiting embodiment, provided is a backpack having an adjustable lumbar support comprised of a chassis with a longitudinal axis, a lumbar support pad, and a slider assembly slidably attaching the lumbar support pad to the chassis. The assembly has a locking slider that, together with the support pad, is indexable to at least two different positions along the chassis.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
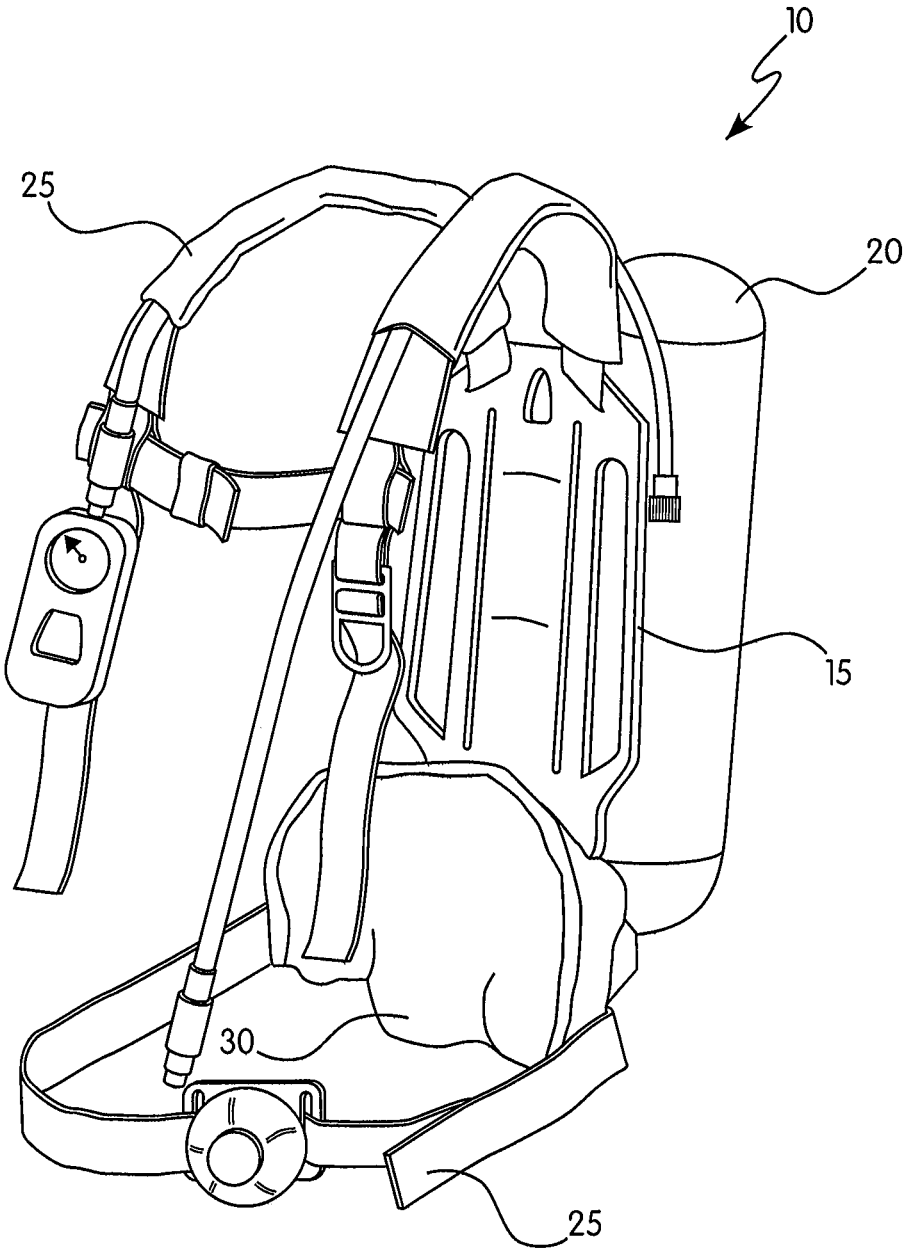
FIG. 1 (Prior Art)
FIG. 1 is prior art and illustrates a self-contained breathing apparatus (SCBA) with a backpack and lumbar support.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

FIG. 1 illustrates an existing backpack 10 of a self-contained breathing apparatus (SCBA), which includes a chassis 15 with an air cylinder 20 secured thereto. Mounting straps 25 secure the backpack 10 to an individual while a lumbar support 30 provides comfort to the user. It is desired to provide a design whereby the lumbar support 30 may be indexed to different positions along the chassis 15 to accommodate the size of a particular user and to enhance comfort.

Figure 2:
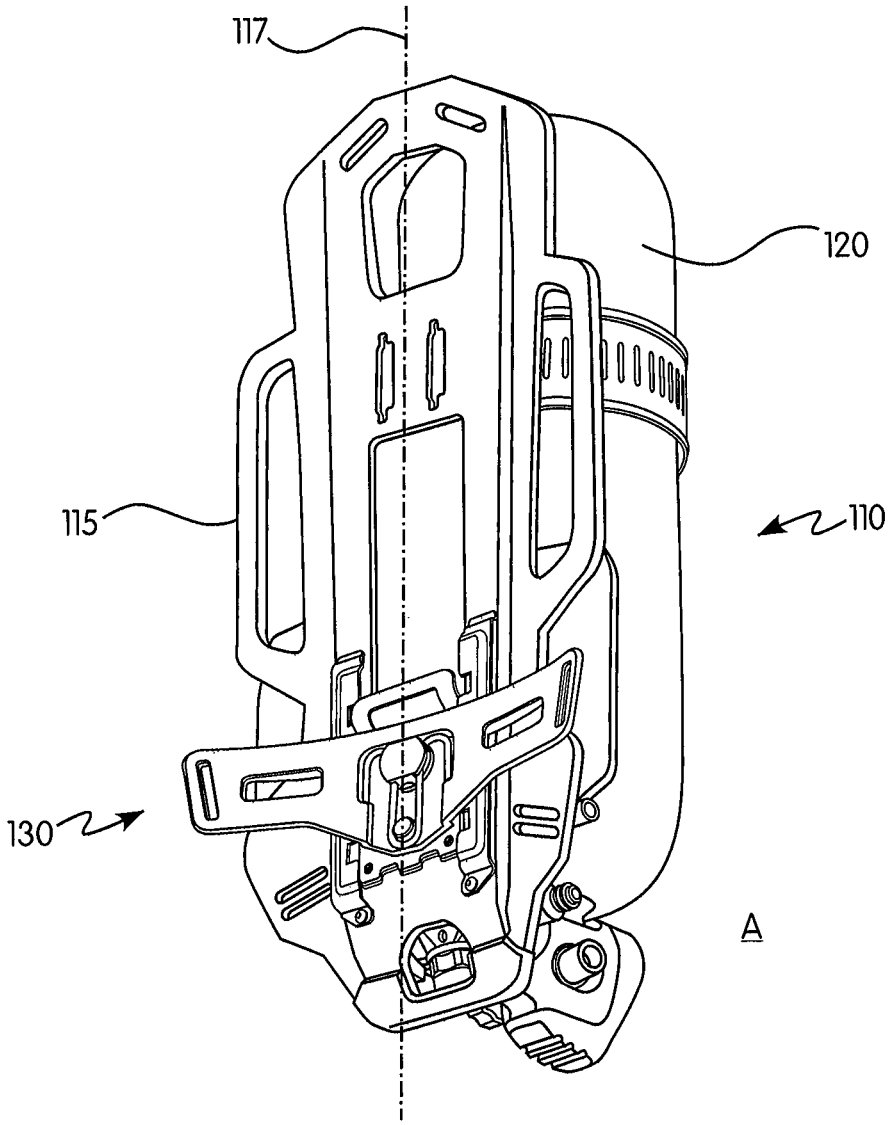
FIG. 2 illustrates a preferred and non-limiting embodiment of the invention showing the adjustable lumbar support in a first position on the chassis of the backpack.
Figure 3B:
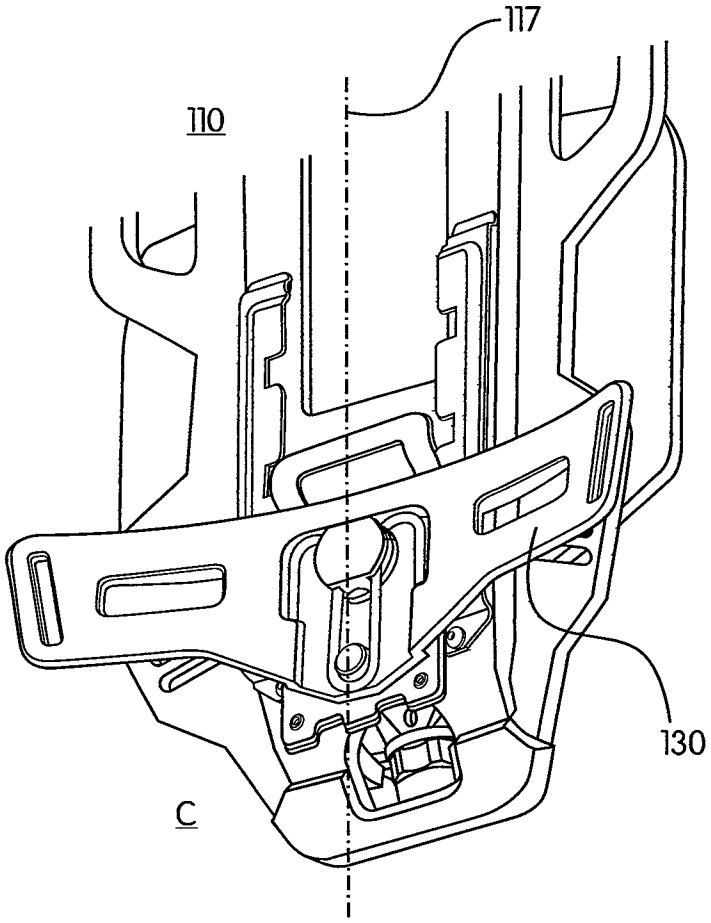
FIGS. 3A and 3B illustrate preferred and non-limiting embodiments of the invention showing the adjustable lumbar support in different positions on the chassis of the backpack.
Figure 3A:
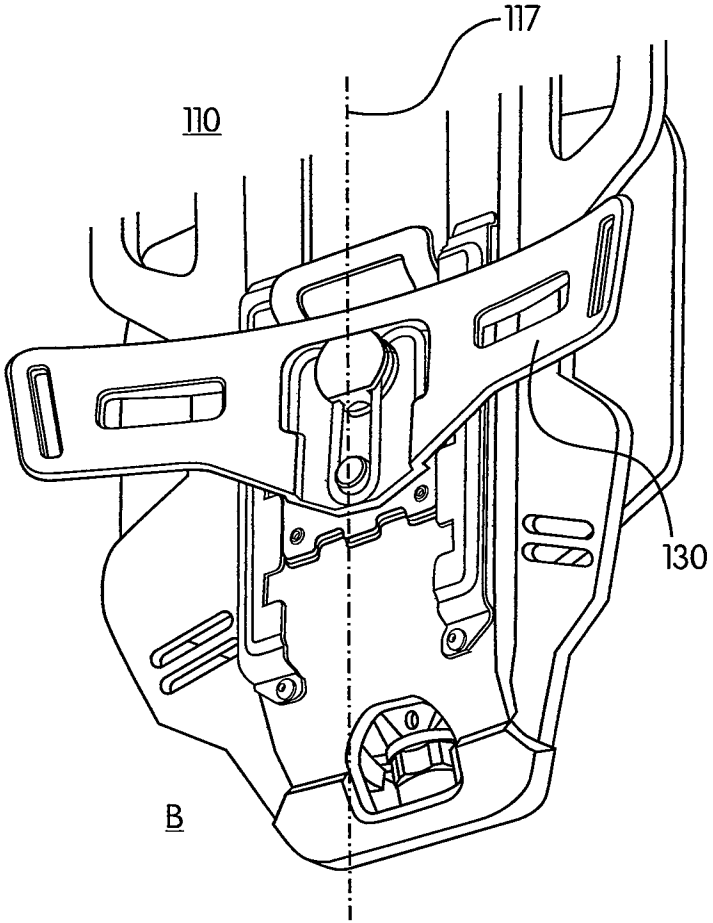

FIG. 2 illustrates one preferred and non-limiting embodiment of a backpack 110 with a chassis 115 for holding an air cylinder 120. An adjustable lumbar support 130 is illustrated in one position A along the longitudinal axis 117 of the chassis 115, while FIGS. 3A and 3B illustrate a portion of the same backpack 110 with the lumbar support 130 shown in different positions B and C along the longitudinal axis 117.

Figure 4:
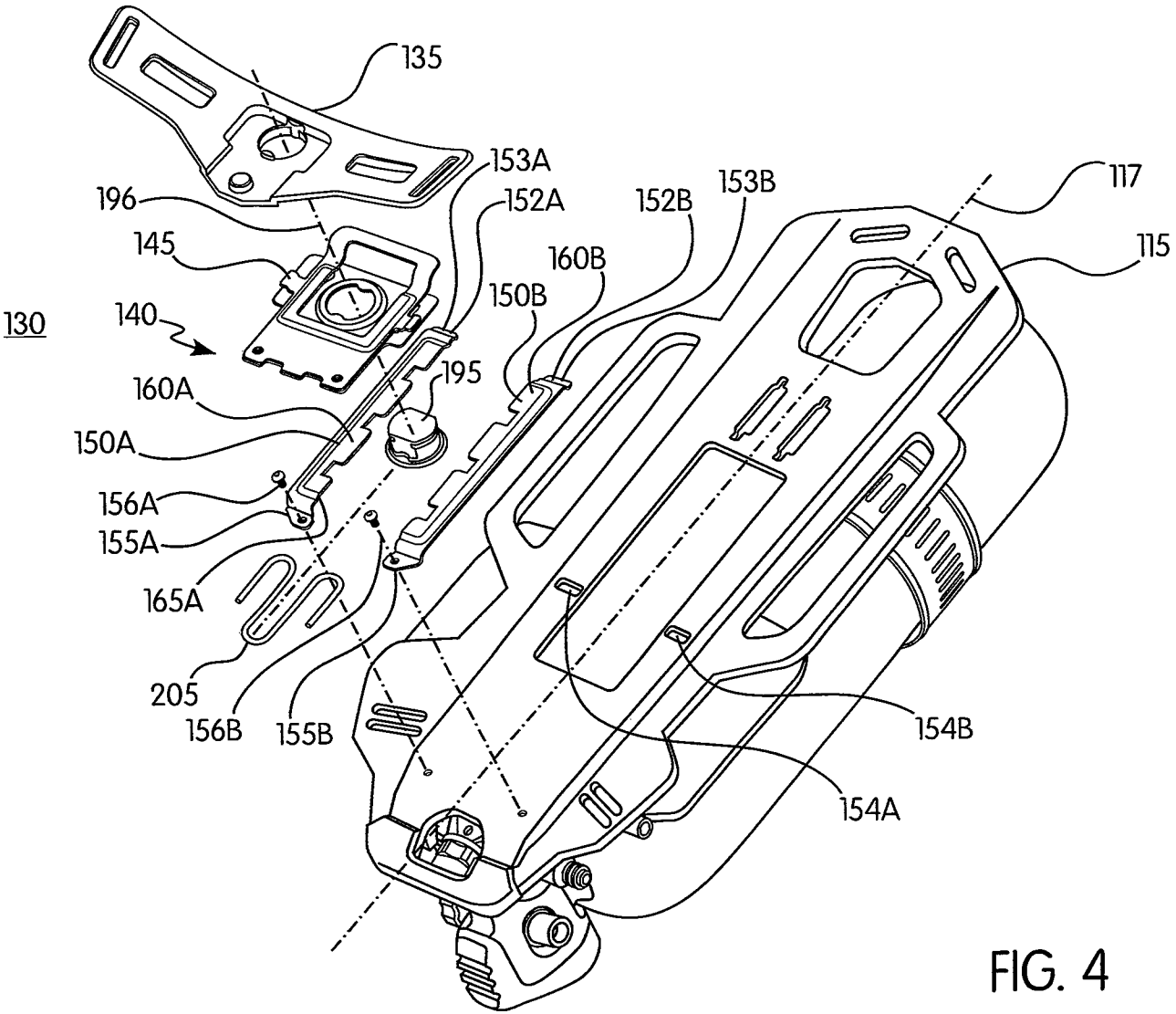
FIG. 4 illustrates an exploded view of an adjustable lumbar support assembly in accordance with the subject invention.

As shown in FIG. 4, the adjustable lumbar support 130 includes a lumbar support pad 135 and a slider assembly 140 attaching the lumbar support pad 135 to the chassis 115. The assembly 140 has a locking slider 145 that, together with the support pad 135, is indexable to multiple, different positions (e.g., positions A, B, and C) along the longitudinal axis 117 of the chassis 115, as illustrated in FIGS. 2, 3A, and 3B.

The slider assembly 140 includes rails, which may be in the form of opposing retention covers 150A, 150B adapted to be secured to the chassis 115. In particular, each retention cover 150A, 150B includes a first end mount 152A, 152B including a projection 153A, 153B that is at least partially accepted within receiving apertures 154A, 154B of the chassis 115, which engage the end mounts 152A, 152B. Second end mounts 155A, 155B may be secured to the chassis 115 with screws 156A, 156B. It should be noted that it is possible to secure the retention covers 150A, 150B to the chassis 115 in a variety of different ways, and the manner disclosed is one of many of those different varieties.

It should be noted that, in one preferred and non-limiting embodiment, the only place in which the slider assembly 140 is attached to the chassis 115 is through the retention covers 150A, 150B, and all of the remaining components move as a single unit relative to the retention covers 150A, 150B.

Henceforth, it should be appreciated that retention covers 150A, 150B are symmetric with one another about the longitudinal axis 117 and, for that reason, the features associated with retention cover 150A will be discussed with the understanding that the same features are applicable to retention cover 150B.

Figure 5A:
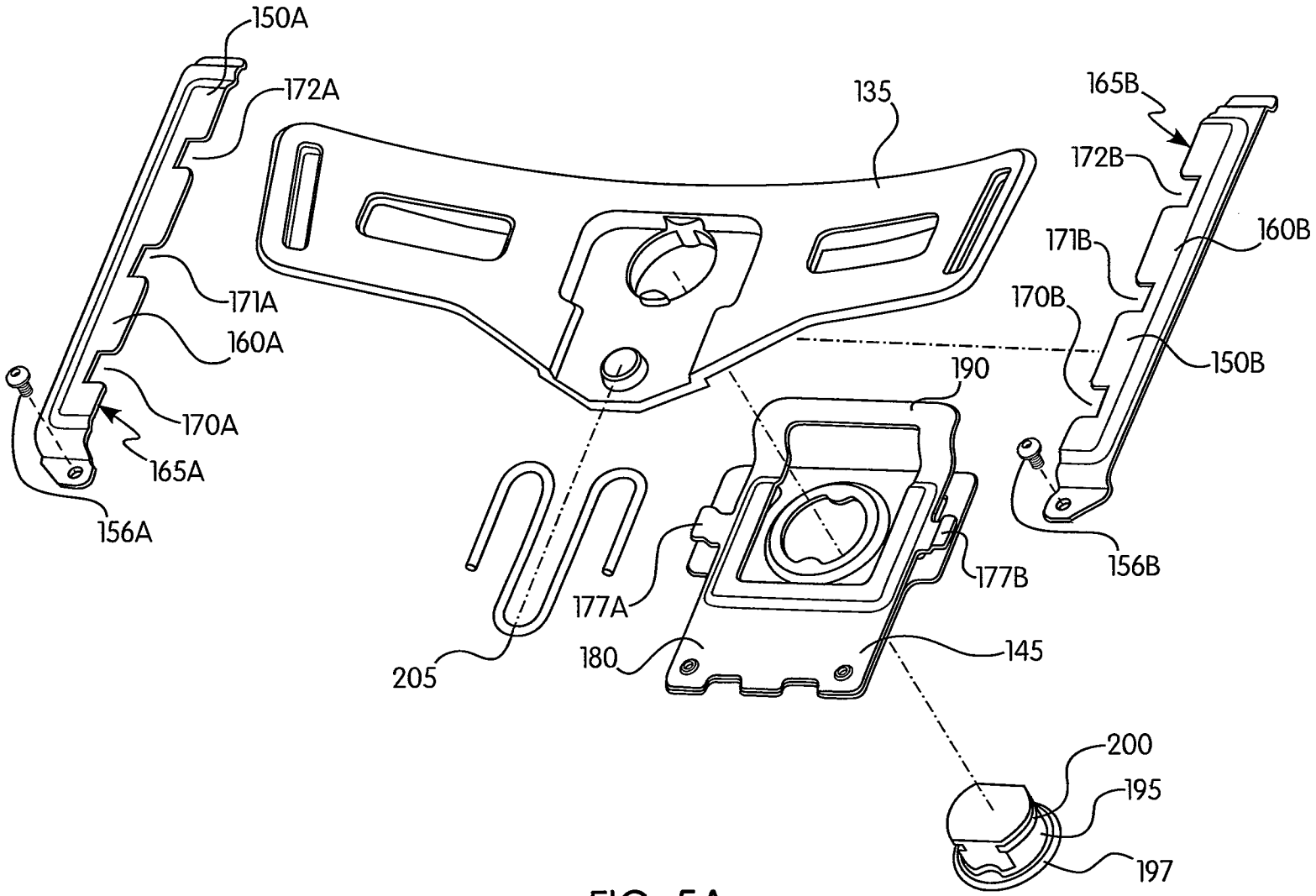
FIG. 5A illustrates an exploded close-up view of the adjustable lumbar support assembly in FIG. 4.
Figure 7:
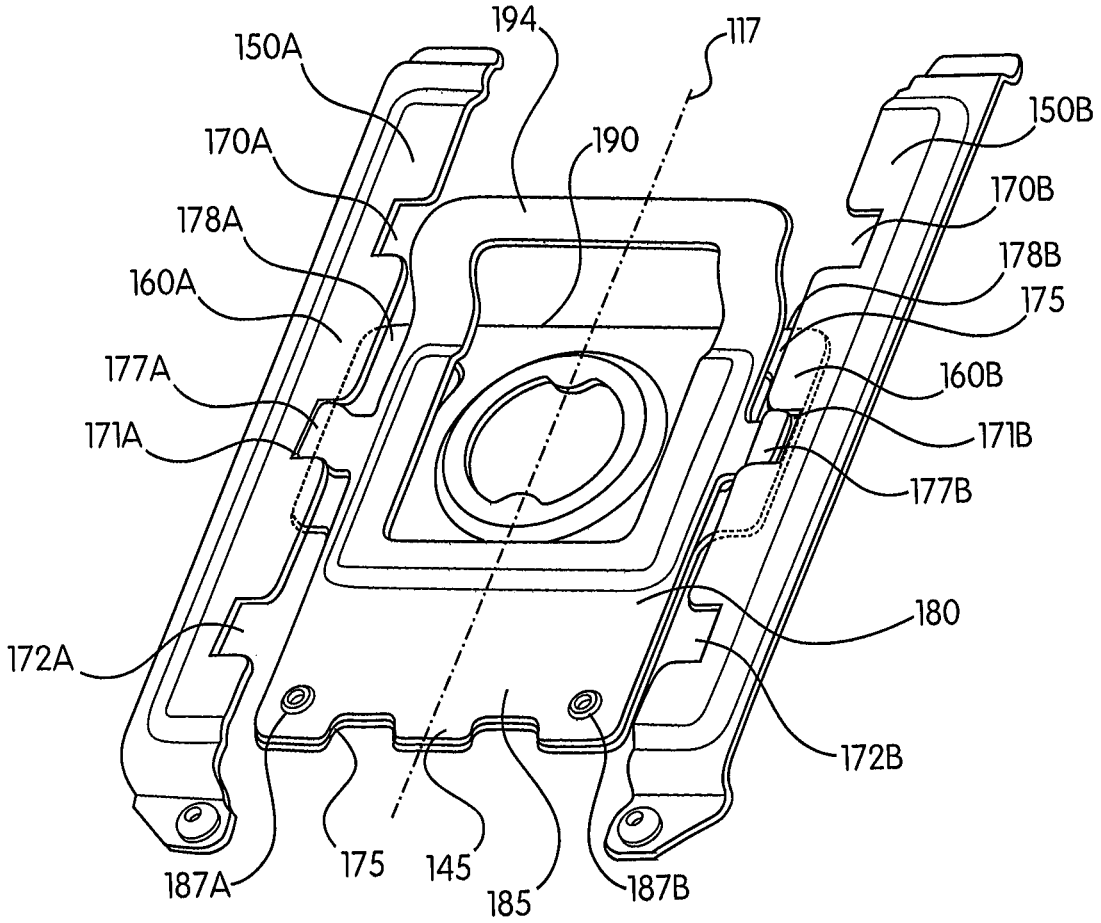
FIG. 7 and FIG. 8 illustrate perspective views of a portion of the adjustable lumbar support assembly with a slider in a first engaged position and a second disengaged position.
Figure 8:
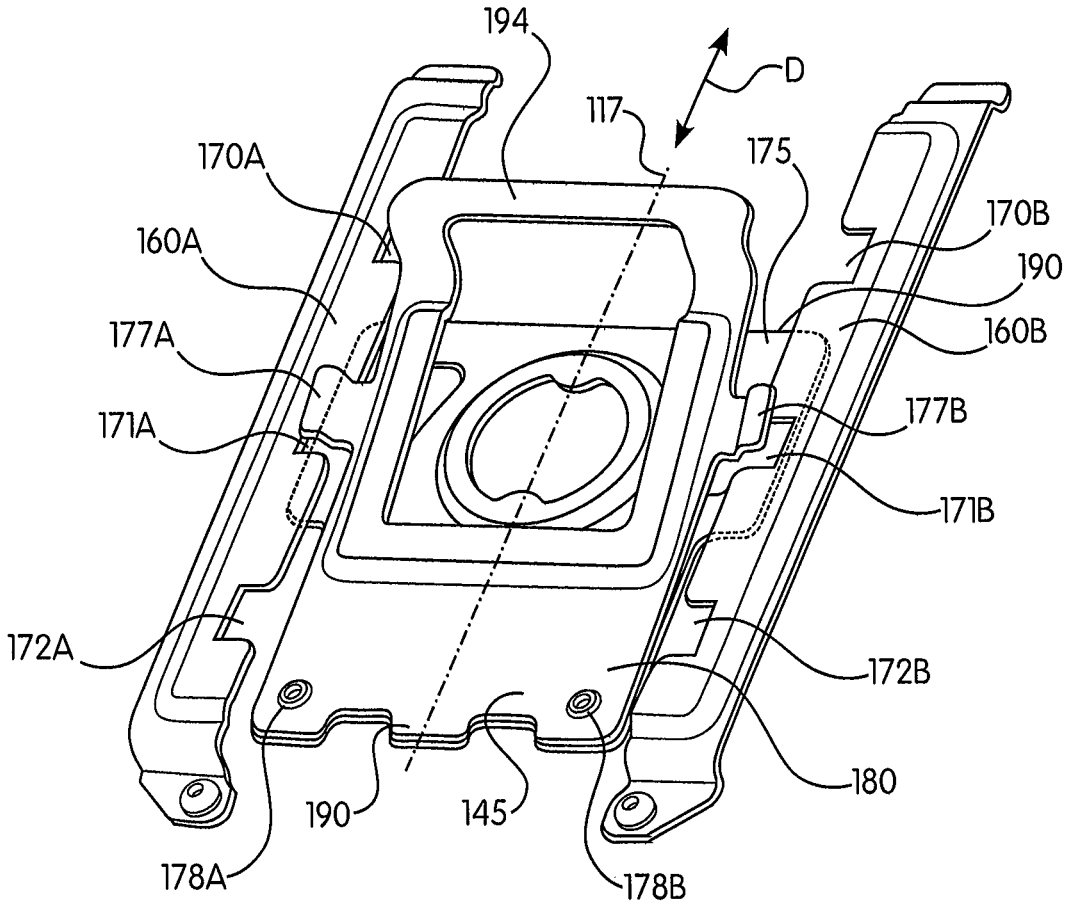

Retention cover 150A, as seen in FIGS. 4 and 5A, includes an elevated portion 160A defining a channel 165A through which the locking slider 145 moves. Each retention cover, such as retention cover 150A, has perforations or slots 170A, 171A, 172A adapted to engage the locking slider 145 at different indexed positions. In particular, as illustrated in FIGS. 7 and 8, as the locking plate 180, with associated tabs 177A, 177B, is lifted or urged away from the retainer plate 175, the tabs 177A, 177B are removed from the respective perforations 171A, 171B, and the locking slider 145 may be moved such that the tabs 177A, 177B may be indexed with other perforations 170A, 170B or 172A, 172B. While the perforations 170-172 are illustrated as slots extending completely through the elevated portion 160A, 160B of the retention covers 150A, 150B, it is also possible for the perforations 170-172 to extend only partially through the elevated portion 160A, 160B, so long as the tabs 177A, 177B are able to engage the perforations sufficiently to prevent motion of the locking slider 145 along the longitudinal axis 117.

Figure 5B:
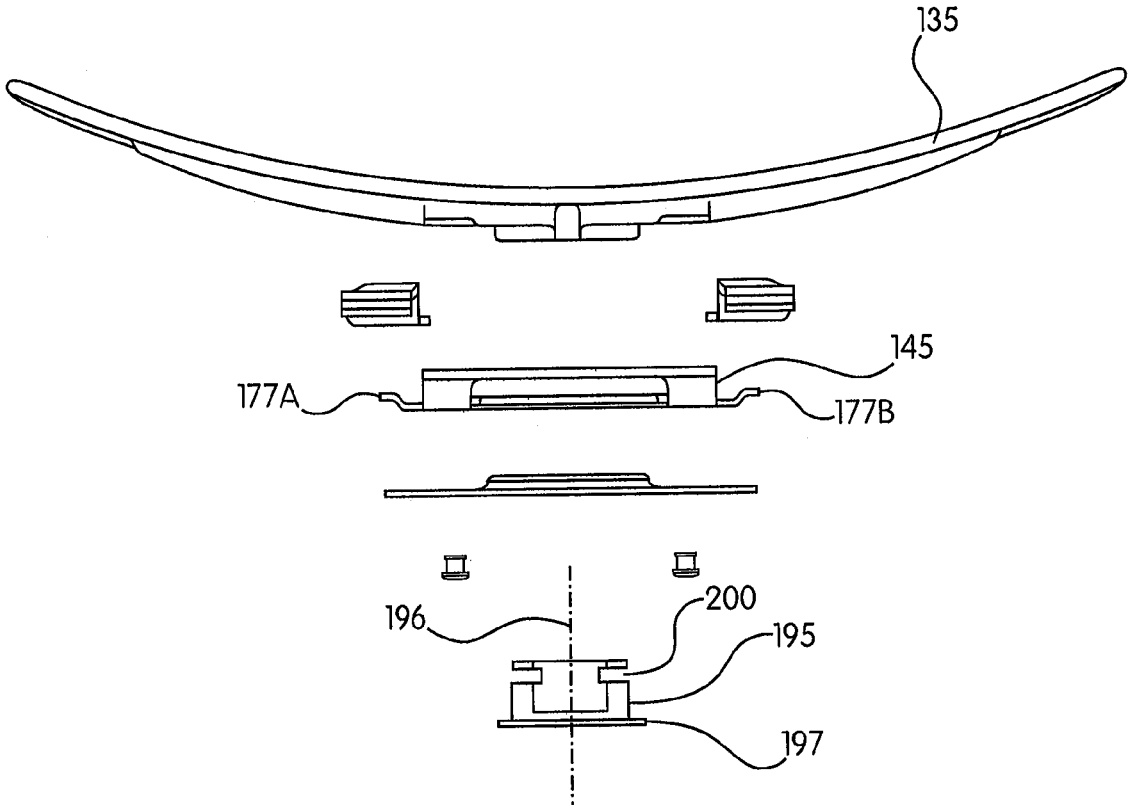
FIG. 5B illustrates an exploded top view of the arrangement illustrated in FIG. 5A.

With further reference to FIGS. 5A and 5B, and in one preferred and non-limiting embodiment, the tabs 177A, 177B are in a "serpentine" or substantially "S"-shaped form. This form facilitates the quick and effective movement of the tabs 177A, 177B into and out of the perforations 170A, 171A, 172A and perforations 170B, 171B, 172B. In addition, such a shaped or configured tab 177A, 177B mitigates against the risk of the tab 177A, 177B passing through or out of engagement with the associated perforation. Similar configurations and shapes for the tabs 177A, 177B are envisioned without departing from the spirit and scope hereof.

With reference to FIGS. 7 and 8, the locking slider 145 is made up of a retainer plate 175 and a locking plate 180 secured together at one end 185 using, for example, rivets 187A, 187B. The plates 175,180 are resiliently separable at the other end 190 relative to one another, as illustrated in FIG. 8. The retainer plate 175 has wings 178A, 178B that are larger than any of the perforations 170A, 171A, 172A and 170B, 171B, 172B that allow the retention covers 150A, 150B to capture the retainer plate 175 along the entire travel of the locking slider 145 in the direction indicated by arrow D. To provide the resilient characteristics, the locking plate 180 may be made of spring steel or other suitable flexible or resilient material.

With the locking plate 180 in a relaxed position against the retainer plate 175 (FIG. 7), tabs 177A, 177B engage perforations 171A, 171B, and the locking slider 145 is fixed relative to the longitudinal axis 117 of the chassis 115. However, with the locking plate 180 separated from the retainer plate 175 (FIG. 8), the tabs 177A, 177B are distanced from the perforations 171A, 171B, such that the locking slider 145 is free to move along the longitudinal axis 117 of the chassis 115 in the direction D.

The locking plate 180, as previously described, is an elastic material that may be resiliently moved away from the retainer plate 175. To promote separation of the locking plate 180 from the retainer plate 175, a handle 194 (FIGS. 7 and 8) may extend from the locking plate 180 for grasping to separate the locking plate 180 from the retainer plate 175.

Figure 6:
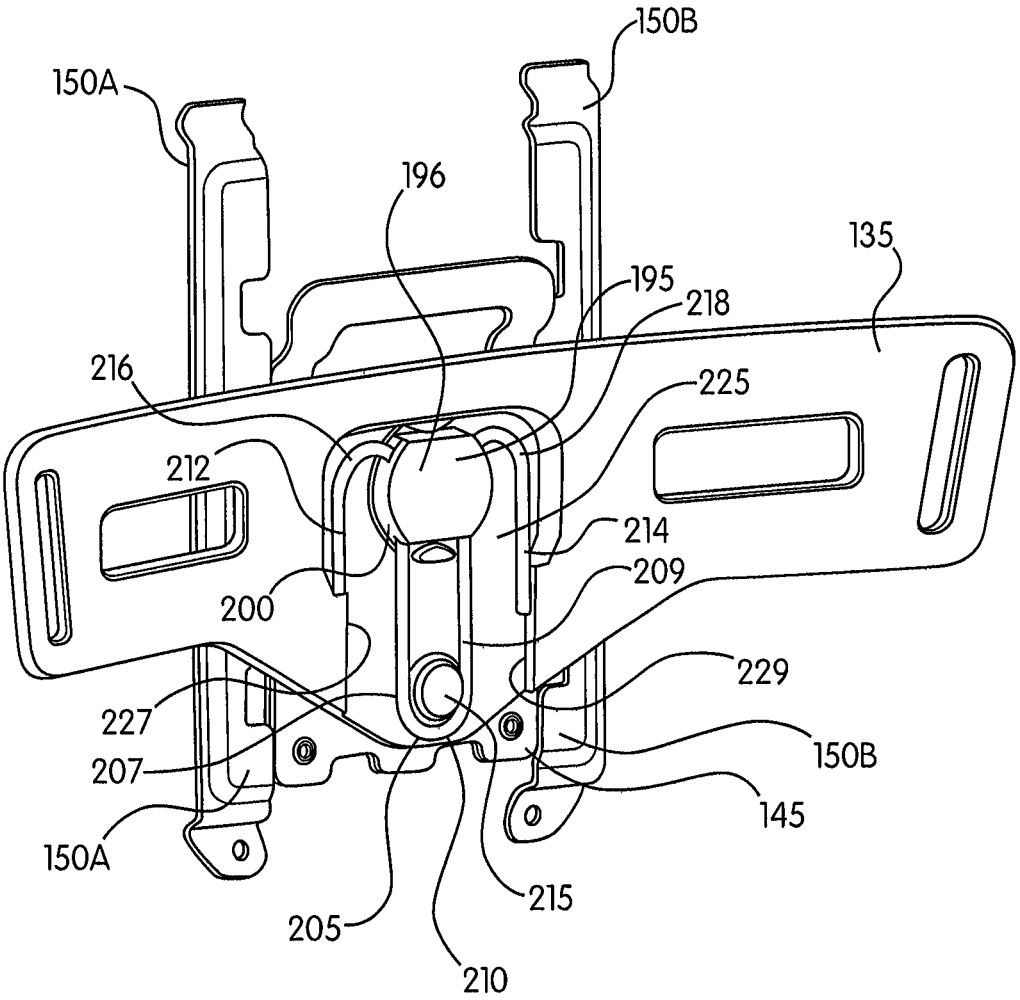
FIG. 6 illustrates an assembled view of the adjustable lumbar support assembly.

Returning to FIG. 5A, the lumbar support pad 135 is secured to the locking slider 145 by a connector arrangement. The connector arrangement may be any of a number of different mechanical fasteners or arrangements known to those skilled in the art. However, as illustrated in FIG. 5, and in one preferred and non-limiting embodiment, the connector arrangement includes a button 195 extending through the locking slider 145 and the lumbar support pad 135. The button 195 has a head 197 at one end that engages the locking slider 145 and a groove 200 at the other end into which at least one connector, e.g., at least one spring clip 205, is inserted or engaged to engage the lumbar support pad 135. The assembled arrangement of these components is illustrated in FIG. 6.

While the spring clip 205 engaging with button 195 is sufficient to retain the lumbar support pad 135 to the locking slider 145, this design also permits the lumbar support pad 135 to rotate about the central axis and, as a result, to rotate relative to the chassis 115 (FIG. 2) for the comfort of the individual utilizing the backpack. In particular, and with reference to FIGS. 6 and 9, the button 195 has a central axis 196 upon which the lumbar support pad 135 may rotate relative to the chassis 115 or to the retention covers 150A, 150B fixed to the chassis 115. With respect to FIG. 6, since the retention covers 150A, 150B are fixed to the chassis 115, the lumbar support pad 135 can rotate relative to these retention covers 150A, 150B. As previously described, the spring clip 205 is inserted within or engaged with a groove 200 of the button 195 to engage the lumbar support pad 135.

Figure 9:
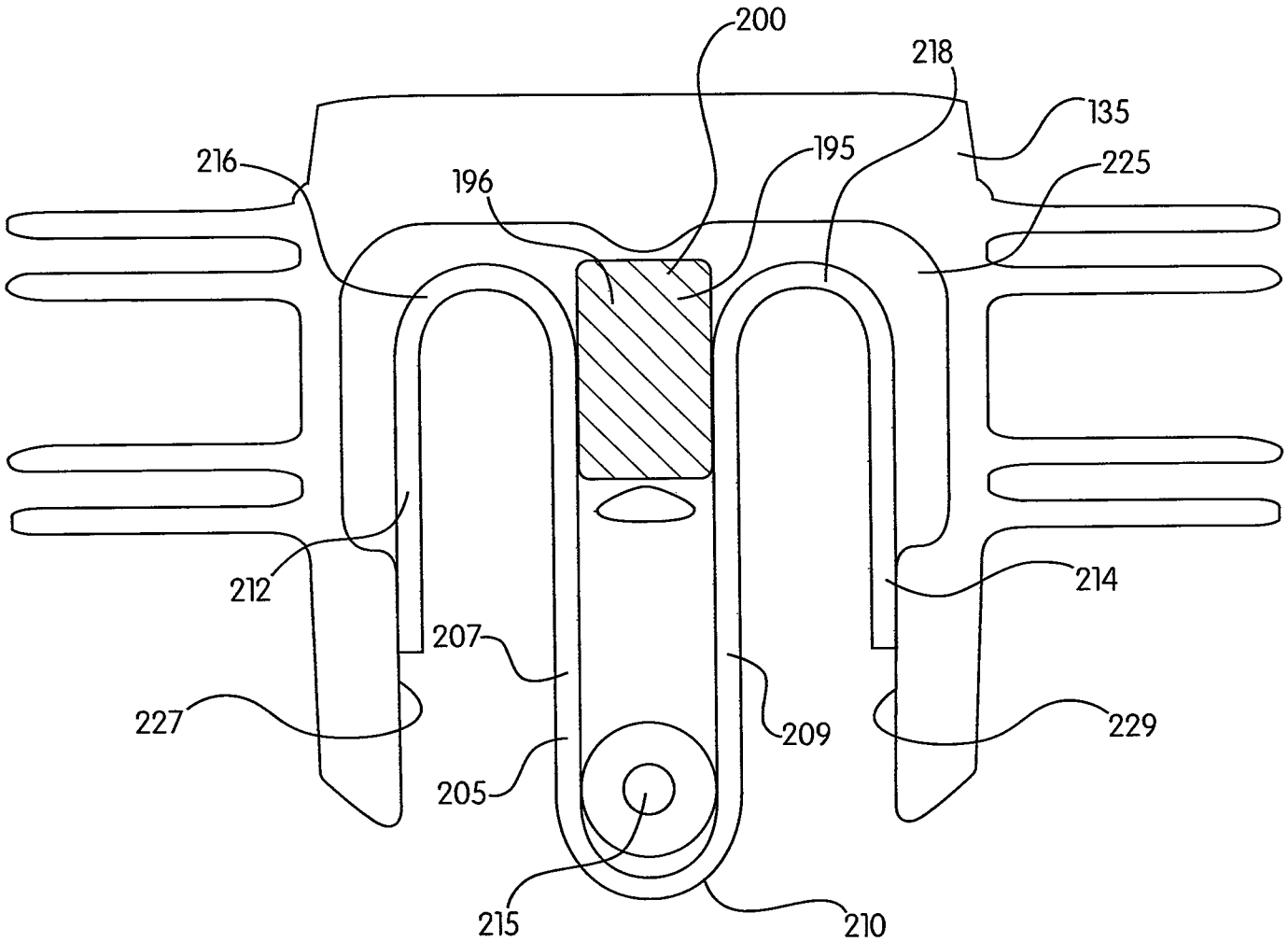
FIG. 9 illustrates a side view of the lumbar pad illustrating the manner by which the spring clip retains the pad to the chassis.

As illustrated in FIG. 9, the button groove 200 is non-circular, and the spring clip 205 is substantially in the shape of a "U", having two extending primary legs 207, 209 connected by a transition portion 210. The lumbar pad 135 further includes a locating pin 215 spaced from the button 195 such that the transition portion 210 contacts the pin 215 and the legs 207, 209 engage and straddle the non-circular groove 200 of the button 195. As a result, rotation of the lumbar support pad 135 relative to the chassis 115 (or relative to the retention covers 150A, 150B) is resiliently resisted when the two legs 207, 209 are spread apart, resulting in a self-centering arrangement.

As illustrated in FIG. 9, the non-circular groove 200 may have the shape of a rectangle. Further, by using such a connector in the form of a spring clip 205 (or any similar such member with deflection characteristics), improved resiliency and deflection is provided to the user. This functionality, and its resulting benefits, may be further enhanced by using a plurality of the above-described spring clips 205, or a spring clip 205 that includes a series of substantially "U" shaped portions with legs—thereby providing additional resiliency and deflection characteristics.

As shown in FIGS. 6 and 9, and in one preferred and non-limiting embodiment, the lumbar support pad 135 has a cavity 225 surrounding the button 195. The spring clip 205 rests within the cavity 225 and further includes two extending secondary legs 212, 214 spaced from and attached to each respective primary leg 207, 209 through transition portions 216, 218 to define a serpentine shape, wherein the two extending secondary legs 212, 214 are compressed against opposing walls 227, 229 of the cavity 225 to provide additional resistance for self-centering.

In this manner, provided is a backpack 110 and adjustable lumber support 130 that represent improvements over existing backpacks and arrangements, with additional and beneficial functionality. The user can effectively adjust the backpack 110 using the adjustable lumber support 130 while wearing the backpack 110, thus making it easier to adjust the position of the backpack 110 during use and in the field. Further, the backpack 110 and adjustable lumbar support 130 according to the present invention represent a simple design with minimal parts and components, thereby leading to reduced maintenance and more effective operation.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An adjustable lumbar support for mounting upon the chassis of a backpack, comprising:

a) a lumbar support pad; and b) a slider assembly slidably attaching the lumbar support pad to the chassis, wherein the assembly comprises a locking slider that, together with the support pad, is indexable to at least two different positions along the chassis, and wherein the locking slider comprises a retainer plate and locking plate secured together and resiliently separable, such that they can be spread apart relative to one another.

2. The adjustable lumbar support according to claim 1, wherein the locking slider comprises a cantilevered elastic material with protruding tabs, wherein the tabs in a first position are engaged with the perforations and in a second position are disengaged from the perforations.

3. The adjustable lumbar support according to claim 1, wherein the retainer plate has at least one wing that allows at least one retention cover to capture the retainer plate along substantially the entire travel of the slider.

4. The adjustable lumbar support according to claim 1, wherein the locking plate includes a handle for grasping to separate the locking plate from the retainer plate.

5. The adjustable lumbar support according to claim 1, wherein the lumbar support pad is secured to the locking slider by a connector arrangement.

6. The adjustable lumbar support according to claim 5, wherein the connector arrangement includes a button with a head at one end that engages the locking slider and is secured to or against the lumbar support pad at the other end.

7. The adjustable lumbar support according to claim 6, wherein the button has a groove at the other end into which at least one connector is inserted to engage the lumbar support pad.

8. The adjustable lumbar support according to claim 1, wherein the slider assembly has opposing rails along which the locking slider moves.

9. The adjustable lumbar support according to claim 8, wherein the rails are opposing retention covers adapted to be secured to the chassis, wherein each cover defines a channel therein in which the locking slider moves.

10. The adjustable lumbar support according to claim 9, wherein at least one retention cover of the opposing retention covers has perforations adapted to engage the locking slider at different indexed positions.

11. The adjustable lumbar support according to claim 10, wherein the perforations are in opposing pairs on each retention cover.

12. The adjustable lumbar support according to claim 10, wherein the perforations are slots extending at least partially through the at least one retention cover.

13. A rotatable lumbar support for mounting upon the chassis of a backpack, comprising:

a) a lumbar support pad; and b) a connector arrangement having a central axis, wherein the connector arrangement secures the lumbar support pad to the chassis and allows the lumbar support pad to rotate or deflect about the central axis relative to the chassis, and wherein the connector arrangement includes a button with a head at one end that engages a slider assembly and is engaged with the lumbar support pad at the other end.

14. The rotatable lumbar support according to claim 13, wherein the button has a groove at the other end into which at least one connector is inserted to engage the lumbar support pad.

15. The rotatable lumbar support according to claim 14, wherein the groove has a substantially rectangular shape.

16. The rotatable lumbar support according to claim 14, wherein the connector arrangement comprises at least one spring clip that is substantially "U"-shaped having two extending primary legs connected by a transition portion, and wherein the slider assembly further includes a locating pin spaced from the button, such that the transition portion contacts the pin and the extending legs engage and straddle the groove of the button, such that rotation of the lumbar support pad relative to the chassis is resisted by resiliently spreading the two extending legs, thereby providing a self-centering arrangement.

17. The rotatable lumbar support according to claim 16, wherein the lumbar support pad has a cavity about the button, and wherein the at least one spring clip rests within the cavity, and further includes two extending secondary legs spaced from each primary leg segment to define a substantially serpentine shape, wherein the two extending legs are compressed against a wall defining the cavity to provide additional resistance for self-centering.

18. A backpack having an adjustable lumbar support, comprising:

a) a chassis with a longitudinal axis;

b) a lumbar support pad; and c) a slider assembly slidably attaching the lumbar support pad to the chassis, wherein the slider assembly comprises a locking slider that, together with the support pad, is indexable to at least two different positions along the chassis, and wherein the locking slider comprises a retainer plate and locking plate secured together and resiliently separable, such that they can be spread apart relative to one another.

* * * * *